US005404647A

United States Patent [19]

Prater

[11] Patent Number: 5,404,647

[45] Date of Patent: Apr. 11, 1995

[54] DRY WALL SIZING APPARATUS

[76] Inventor: Vernon Prater, 81 S. Encina, Visalia, Calif. 93291

[21] Appl. No.: 174,349

[22] Filed: Dec. 28, 1993

[51] Int. Cl.[6] ..... B26B 29/06

[52] U.S. Cl. ..... 30/293; 30/294; 33/32.2

[58] Field of Search ..... 30/289, 290, 291, 292, 30/293, 294, 164.9, 164.95; 83/614, 745; 33/32.2, 528

[56] References Cited

U.S. PATENT DOCUMENTS

| | | | |
|---|---|---|---|
| 2,437,971 | 3/1948 | Russell | 30/293 |
| 3,284,895 | 11/1966 | Selander et al. | 83/411.3 |
| 4,949,462 | 8/1990 | Spencer | 30/294 |
| 5,048,189 | 9/1991 | Aurness et al. | 30/293 |
| 5,083,375 | 1/1992 | Helm, Sr. | 30/293 |
| 5,153,998 | 10/1992 | Duncan | 30/290 |
| 5,197,195 | 3/1993 | Aikens | 30/293 |
| 5,265,342 | 11/1993 | Lang, Jr. | 30/290 |

*Primary Examiner*—Eugenia Jones
*Assistant Examiner*—Allan M. Schrock

[57] ABSTRACT

The present invention comprises a sizing and cutting tool for accurately and quickly producing pieces of wall board of predetermined size from a larger sheet, wherein a cutting instrument is affixed to one end of a bar, and having a sizing plier disposed in releasable gripping relation along the bar, and adapted to grip said bar at a determinable distance from said cutting instrument to thereby determine a dimension of the piece to be cut, and wherein the sizing plier includes a flange adapted to slide on a reference edge of the wall board, and a cam for engagement with the face of the wall board to permit limited rotation of said tool relative to the surface of said wall board during cutting thereof.

13 Claims, 1 Drawing Sheet

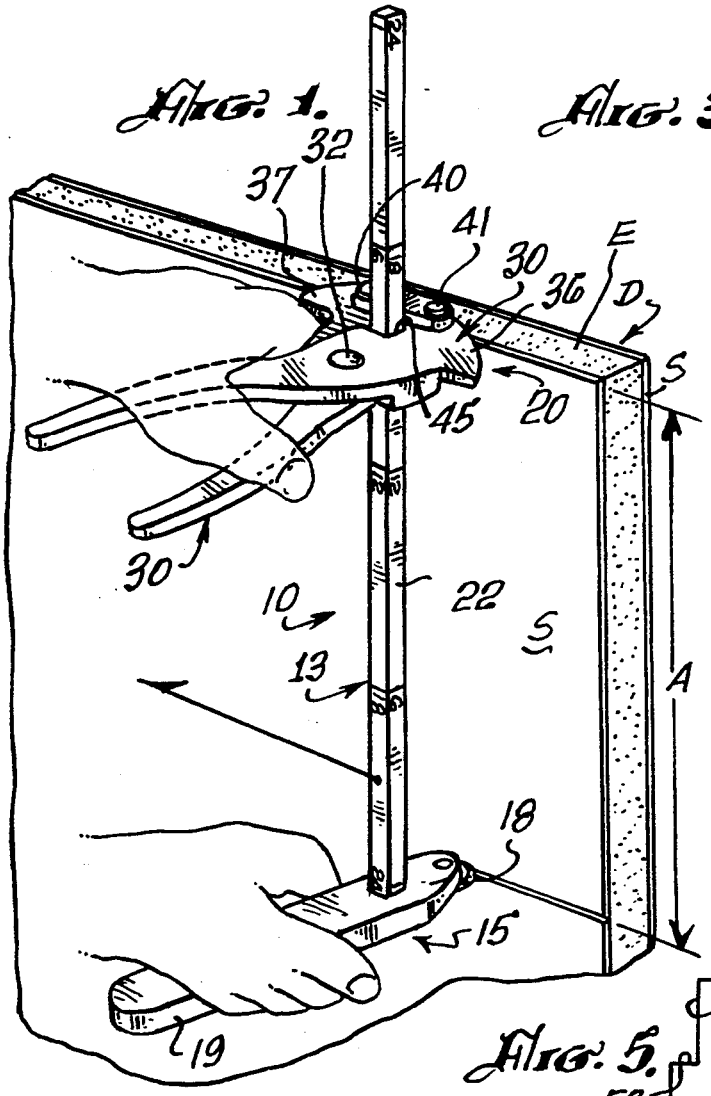
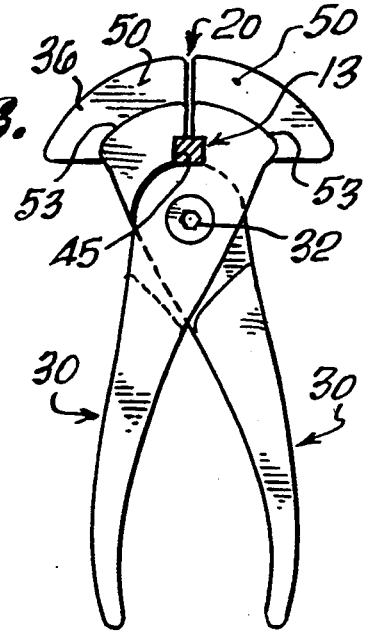
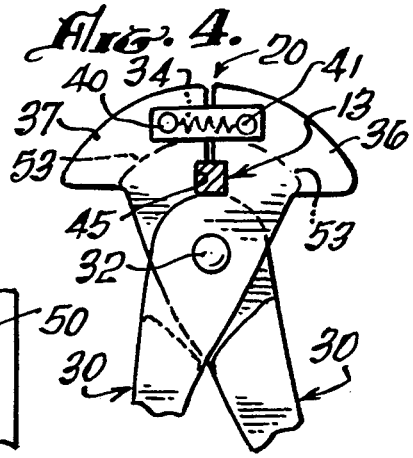
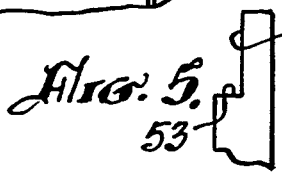
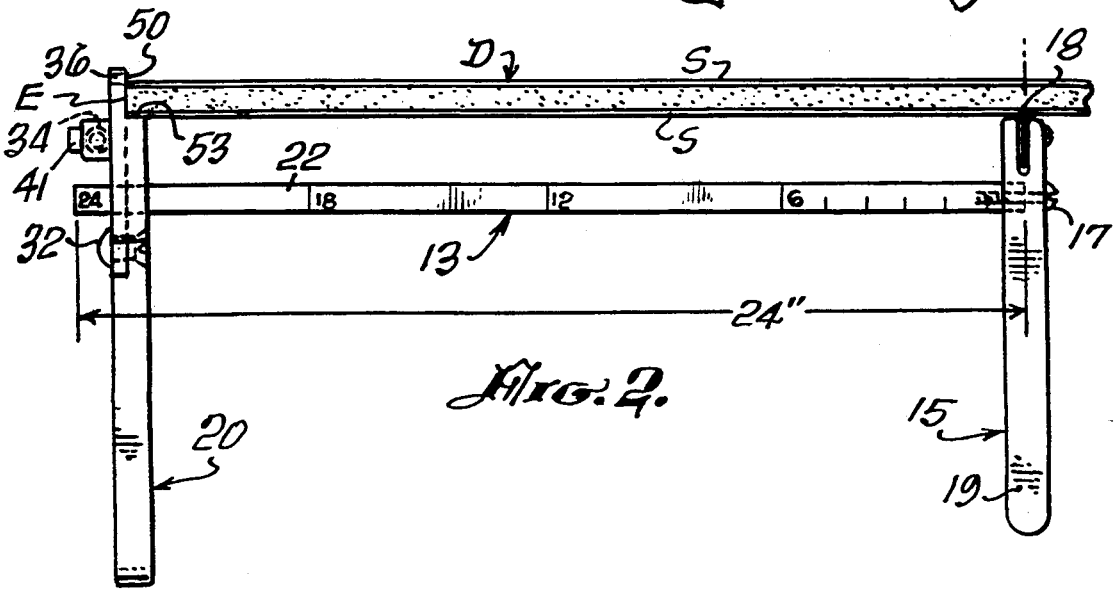
Fig. 2.

DRY WALL SIZING APPARATUS

The present invention relates generally to devices for sizing and cutting drywall with exceptional speed and accuracy and, more particularly, to such devices which combine both a measuring and cutting function.

BACKGROUND OF THE INVENTION

1. Field of the Invention

Since the advent of dry wall as an alternative to lathe and plaster, the construction industry has continually worked to improve the ability of the dry wall applicator to reduce the customary 4'×8' sheets of dry wall, of varying thicknesses, to smaller, and sometimes odd shaped, pieces to fit into nonstandard spaces.

Early applicators would typically use a straight edge and a measuring device to inscribe a line on the paper surface of the sheet of dry wall, and then cut, free hand, with a cutting device such as a saw. The resulting product often had rough edges and may or may not fill the intended space, depending on the skill and dexterity of the person doing the cutting. The roughness of the edges, and the accuracy of the cut increased the difficulty of taping the seams, and thus the aesthetics of the job.

2. Overview of the Prior Art

The importance of being able to expeditiously size and cut dry wall with great accuracy is evidenced by the significant number of patented devices intended to accomplish these goals on site.

Among the more relevant art is Crawford U.S. Pat. No. 2,818,644, which uses what appears to be a yard stick, upon which is mounted a slidable stop. At one end there is a cutting device, and at the other, an additional stop.

Spencer U.S. Pat. No. 4,949,462 is representative of another group of patents in which the cutting device is movable on a "T" square.

Other, less relevant, art is represented by Aurness U.S. Pat. No. 5,048,189, Helm U.S. Pat. No. 5,083,375, Kuhlmann U.S. Pat. No. 4,628,608, and Aikens U.S. Pat. No. 5,197,195.

While each of these patented devices represents an attempt to increase efficiency and workmanship, none are capable of the speed and accuracy of the present invention.

SUMMARY OF THE INVENTION

The present invention comprises a device for quickly and accurately sizing and cutting wall board, on the job, with such ease that a journeyman applicator can do quality work of an artisan with almost no training or experience.

Accordingly, it is a fundamental objective of the present invention to provide a simple hand tool that is capable of sizing and cutting pieces of wall board with great speed and accuracy, on the job site.

It is a further objective of the present invention to provide such a tool which is capable of cutting elongated pieces with a single stroke, thereby materially increasing the users efficiency and speed.

It is yet another objective of the present invention to provide a hand tool which is virtually instantly adjustable to provide a predetermined distance between a cutting instrument and a stop, to thereby determine the dimension of the piece of wall board to be cut.

There are, of course, several ancillary benefits to be derived from the use of the tool of the present invention, which will occur to those skilled in the art, upon reading the detailed specification in conjunction with the drawings, wherein:

DESCRIPTION OF THE DRAWINGS

FIG. 1 is a pictorial view of the tool of the present invention, illustrated in use in a typical work environment;

FIG. 2 is a top view of the tool illustrating the assemblage of the various parts, or elements, of the tool:

FIG. 3 illustrates a portion of the quick adjust stop mechanism;

FIG. 4 illustrates that portion of the quick adjust stop mechanism which contacts the wall board itself, to provide a stopping and camming action; and, FIG. 5 is an end view of the upper portion of the quick adjust stop mechanism, illustrating certain features thereof not otherwise visible in other FIGURES.

DETAILED DESCRIPTION OF A PREFERRED EMBODIMENT

With reference now to the drawings, and particularly to FIG. 1, a dry wall sizing and cutting tool is illustrated at 10.

The tool 10 is shown, in use, cutting a piece of dry wall D, to a predetermined dimension A. Dry wall, or wall board D has a reference edge E, from which smaller pieces are dimensioned and cut, and there are opposed flat surfaces S, along which the tool 10 rides as it functions.

In keeping with the invention, the tool 10 comprises an elongated rod 13. As may be seen in FIGS. 3 and 4, in order to enhance the capability of the tool to assume a predetermined dimension, and hold it, the rod 13 is square in cross section, although other geometric, or at least other than round configurations, may be employed without departure from the inventive concept.

Further, in reference to FIG. 1, the tool has a cutting instrument 15 affixed at one end of the bar 13. The manner of fixation is one of choice, and as illustrated, a machine screw 17 will provide adequate positioning and rigidity between the bar 13 and the cutting instrument 17. The cutting instrument 15 includes a cutting blade 18, in the case shown, of circular configuration, in a handle 19.

Disposed on the bar 13, opposite the cutting instrument, there is, in accordance with the invention, a sizing plier 20. It will be observed in FIGS. 1 and 2 that the bar or rod 13 is inscribed along one or more of its sides 22, with at least one scale. The scale may be of any standard configuration, but typically in inches and fractions thereof. As a benefit to the user, the scales may run in opposite directions, and due to the width of a standard piece of wall board, run between 0 and 24", thus making the tool versatile in any direction.

The sizing plier of the present invention offers several innovations which further enhance the invention. As best seen in FIGS. 3 and 4, opposed plier halves 30 are interconnected by a fastener 32. The plier halves are, in keeping with the invention, normally biased toward the closed position. This is accomplished in one of several ways, such as by use of spring 34. As seen in FIG. 4, the spring 34 is secured to, and between, the upper ends, or jaws, 36 and 37, respectively, of the plier halves 30, in any well known manner, such as by rivets 40 and 41.

The spring 34 thus biases the plier halves toward their normally closed position about the bar.

The jaws 36 and 37, when in their closed position, define an opening 45, having the same configuration as the cross section of the bar 13, and dimensioned slightly smaller such that when the bar is in the opening 45, the sizing plier 20, in its closed position firmly grips the bar, thereby holding the plier in any desired position along the bar. To release the sizing plier from the bar, the user need only to squeeze the grip portion 47 of each plier half 30, against the bias of the spring 34. This action spreads the upper ends 36 and 37 to thereby release the gripping pressure on the bar in order that the sizing plier may be repositioned along the bar.

In keeping with yet another aspect of the invention, the sizing plier also serves as a stop for positioning the tool 10 on a piece of wall board D. To this end, the upper ends 36 and 37 of the plier halves 30 are formed with a stop flange 50. As seen in FIG. 1, each stop flange 50 presents a flat smooth surface to a reference edge E of the wall board in order that it may slide along the edge as the tool is moved.

One of the excellent features of the tool of the present invention is the speed with which it functions. In order to enhance this feature, there is provided on each plier half 30, a cam 53. The cam is contiguous with, and transverse to, the stop flange 50, and the surface is intended to ride on the flat paper face of the wall board D. The cam 53 is arcuate in configuration, in order that the tool can be rolled on the flat facing surface of the wall board as the tool is moved laterally.

In use, the sizing and cutting tool 10 has proven to be both accurate and fast. If, for example a 12″×8′ piece of wall board is required, the user simply squeezes the handles 47 of the sizing plier to release the grip on the bar or rod 13. The plier 20 is then moved along the scale to a position which is 12″ from the cutting instrument, and pressure on the handles is released so that the plier 20 regrips the bar 13 at the precise position desired. With the user standing at approximately the midpoint of the wall board D, the flange 50 of the plier 20 rests on the edge E of the wall board at one end thereof, and with one sweep of the tool across the face of the wall board, rotating on the cam as it goes, a clean, accurate cut is achieved.

Because of the ability of the tool to rotate along the cam as it goes, without effecting the cutting instrument, an average man can quickly span an 8′ piece of wall board without having to change position, thereby greatly contributing to the efficiency of the tool.

Having thus described a preferred embodiment of my novel tool, what is claimed is:

1. A sizing and cutting tool for accurately and quickly cutting pieces of wall board of predetermined smaller size from a larger sheet, wherein the larger sheet has a reference edge and opposed flat facing surfaces, comprising, in combination:

a bar, said bar being elongated, and having at least two scales thereon;

a cutting instrument, said cutting instrument being affixed to one end of said bar;

sizing means disposed in releasable gripping relation with said bar, said sizing means adapted to grip said bar at a determinable distance from said cutting instrument to thereby determine a dimension of a piece to be produced, said sizing means including a flange, said flange having a surface which is adapted to slide on the reference edge of the larger sheet;

said sizing means including cam means disposed transversely to said flange surface for engagement with one of the flat facing surfaces the larger sheet to permit limited rotation of said tool relative to the surface of said wall board during cutting thereof.

2. The tool of claim 1, wherein said bar is non-round in cross section.

3. The tool of claim 2, wherein said sizing means comprises a sizing plier, said sizing plier being biased towards a closed, gripping rotation about said bar.

4. The tool of claim 2, wherein said sizing plier includes gripping means for opening said plier against its bias.

5. The tool of claim 2, wherein said cam means comprises an arcuate surface.

6. The tool of claim 2, wherein said cam means engages the flat facing surface of the larger sheet as said flange engages the reference edge thereof.

7. The tool of claim 1, wherein said scales ascend in opposite directions.

8. The tool of claim 7, wherein said scales run from 0 to 24″.

9. The tool of claim 1, wherein said sizing means comprises a sizing plier, said sizing plier being biased towards a closed, gripping relation about said bar.

10. The tool of claim 1, wherein said sizing plier includes gripping means for opening said plier against its bias.

11. The tool of claim 9, wherein said cam means comprises an arcuate surface.

12. The tool of claim 9, wherein said cam surface engages the flat facing surface of the larger sheet as said flange engages the reference edge thereof.

13. The tool of claim 1, wherein said cam means engages the flat surface of the larger sheet as said flange engages the reference edge therof.

* * * * *